United States Patent [19]

Marek

[11] 4,183,511

[45] Jan. 15, 1980

[54] WORK HOLDER FOR ADJUSTABLY SUPPORTING A WORKPIECE

[76] Inventor: Richard G. Marek, 819 - 60th St., Kenosha, Wis. 53140

[21] Appl. No.: 938,058

[22] Filed: Aug. 30, 1978

[51] Int. Cl.[2] ..... B66F 3/00

[52] U.S. Cl. ..... 269/17; 254/100; 269/60; 269/71

[58] Field of Search ..... 269/17, 71, 60, 73; 254/100, 124, 133, 134; 72/705

[56] References Cited

U.S. PATENT DOCUMENTS

| | | | |
|---|---|---|---|
| 1,127,708 | 2/1915 | Wilber | 269/71 |
| 2,763,053 | 9/1956 | Andersen | 254/133 R X |
| 2,997,292 | 8/1961 | Lucker et al. | 254/134 |
| 3,719,347 | 3/1973 | Wolgast et al. | 254/124 |
| 4,066,243 | 1/1978 | Johnson | 254/133 R |

*Primary Examiner*—Robert C. Watson

*Attorney, Agent, or Firm*—Michael, Best & Friedrich

[57] ABSTRACT

Disclosed herein is a work holder for supporting a workpiece, the work holder including a frame and an upright member supported by the frame and having a longitudinal axis. The work holder also includes a support member for supporting the workpiece, and a bracket member supporting the support member and supported by the upright member for movement longitudinally on the upright member. The support member is also supported for pivotal movement about a generally horizontal axis and about an axis transverse to both the generally horizontal axis and the upright member.

12 Claims, 6 Drawing Figures

WORK HOLDER FOR ADJUSTABLY SUPPORTING A WORKPIECE

BACKGROUND OF THE INVENTION

The invention relates to work holders used for supporting workpieces, and more particularly to tools for supporting workpieces such as automotive body parts and for positioning of such workpieces while they are being installed or removed from a vehicle.

Attention is directed to the Allen et al. U.S. Pat. No. 3,030,103, issued Apr. 17, 1962, illustrating a tool for holding vehicle components during removal or installation and including a support member which is vertically movable to permit vertical adjustment of the position of the workpiece.

Attention is also directed to the Martin U.S. Pat. No. 2,976,033, issued Mar. 21, 1961, and illustrating a servicing stand for use in supporting aircraft ejection seats so that they can be serviced.

SUMMARY OF THE INVENTION

The invention includes a work holder for supporting a workpiece, the work holder including a frame and an upright member supported by the frame and having a longitudinal axis. The work holder further includes a support member for supporting the workpiece and means for supporting the support member for movement along the longitudinal axis including a bracket member supported by the upright member and movable longitudinally on the upright member. The work holder also includes means for supporting the support member for pivotal movement about a generally horizontal axis, and means for supporting the support member for tilting movement about an axis transverse to the generally horizontal axis and transverse to the upright member.

One of the principal features of the invention is the provision in the work holder of means for supporting the support member for movement along the longitudinal axis including a rotatable screw supported by the upright member and generally parallel to the upright member, and means for threadably coupling the bracket member to the screw for causing movement of the bracket member longitudinally on the upright member in response to rotation of the screw.

Another of the principal features of the invention is the provision in the work holder of a support member including a first mounting plate and a pair of spaced arms supported by the first mounting plate and extending away from the first mounting plate, and means for supporting the support member for tilting movement including a second mounting plate supported by the bracket member and positioned in adjacent parallel relation with the first mounting plate, and means for supporting the first mounting plate for pivotal movement with respect to the second mounting plate about an axis perpendicular to the mounting plates.

Another of the principal features of the invention is the provision in the work holder of at least one upwardly and outwardly extendable arm supported by the bracket member, and a second extendable arm supported by the upwardly and outwardly extendable arm, the second extendable arm having a free end supporting a suction member, the suction member engageable with the workpiece for supporting the workpiece.

Other features and advantages of the invention will become known by reference to the following description, to the appended claims, and to the drawings.

Figure 1:
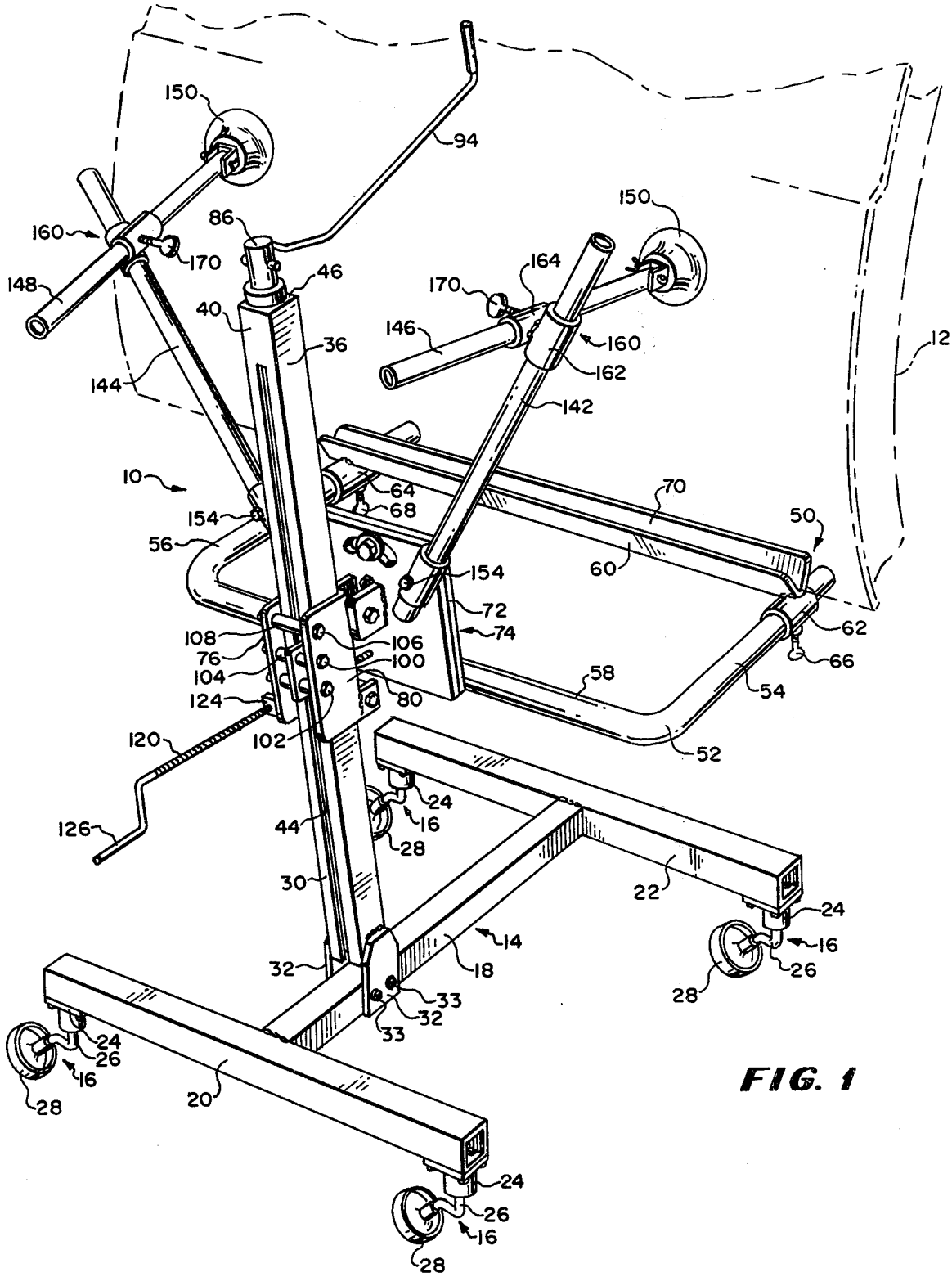
FIG. 1 is a perspective view of a work holder embodying the present invention and showing a vehicle body component in phantom supported by the work holder.

Before explaining at least one embodiment of the invention in detail, it is to be understood that the invention is not limited in its application to the details of construction and the arrangement to the components set forth in the following description or illustrated in the drawings. The invention is capable of other embodiments and of being practiced and carried out in various ways. Also, it is to be understood that the phraseology and terminology employed herein is for the purpose of description and should not be regarded as limited.

DESCRIPTION OF THE PREFERRED EMBODIMENT

Figure 2:
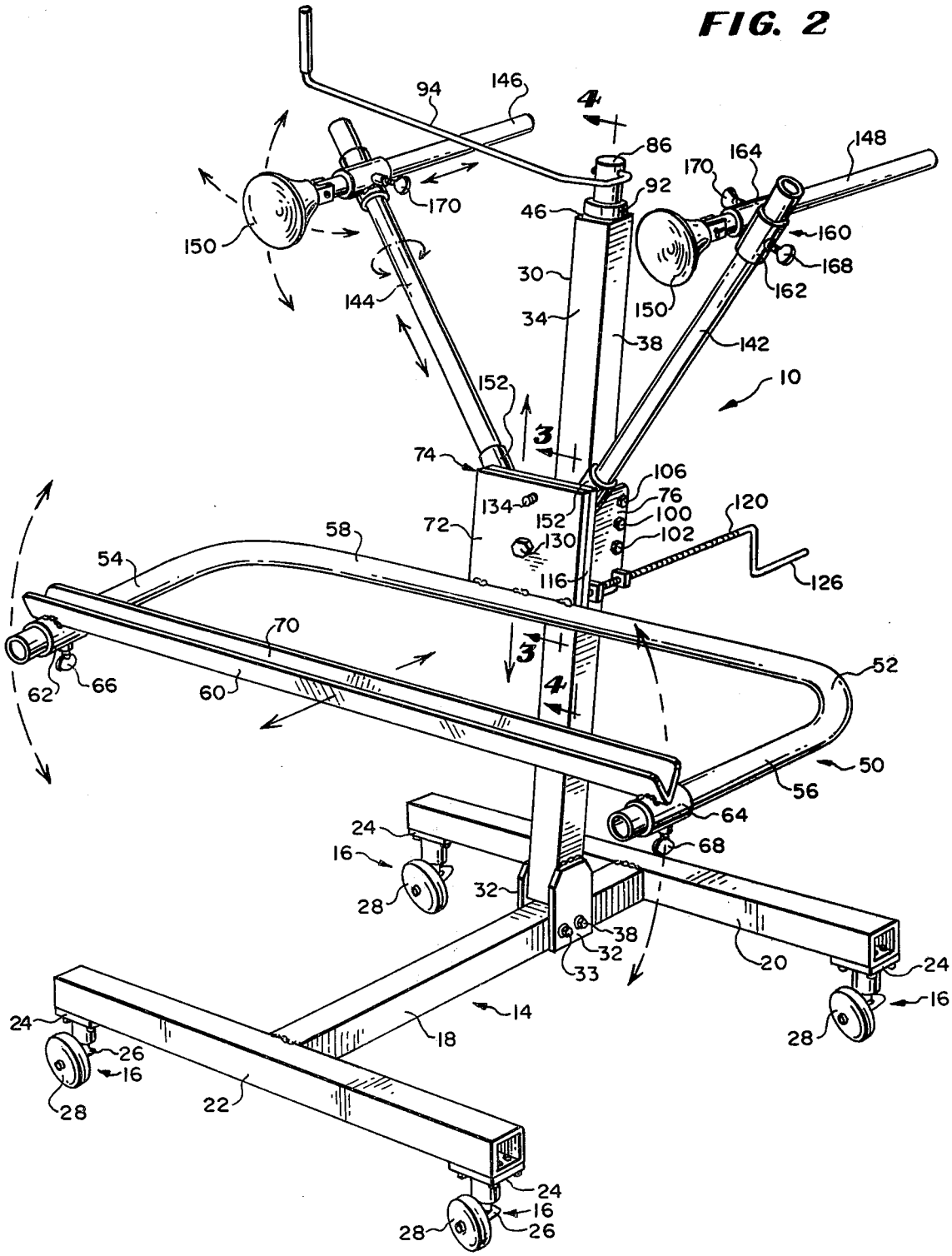
FIG. 2 is another perspective view of a work holder shown in FIG. 1 and showing the permissible movement of the components of the work holder.

Illustrated in FIGS. 1 and 2 is a work holder 10 for holding workpieces such as vehicle components while such components are being installed or removed from a vehicle. As an example of items which can be conveniently supported by the work holder 10, the work holder 10 is illustrated in FIG. 1 as supporting a door 12 of a vehicle. It will be recognized by those skilled in the art that the work holder 10 can also be employed to support a variety of other types of workpieces.

The work holder 10 provides a portable unit including a frame means supported for movement along the ground. While various arrangements can be provided, in the illustrated construction the frame means includes an H-shaped frame or base 14 supported by a plurality of casters 16. The H-shaped frame 14 includes a central linear frame member 18 having opposite ends, and also includes transverse linear frame members 20 and 22, respectively, connected to the opposite ends of the frame member 18. In the illustrated construction, the frame members 18, 20 and 22 have rectangular cross sectional configurations. However, other types of frame members could also be employed, and could be connected to form various configurations. The casters 16 are supported on the opposite ends of each of the transverse linear frame members 20 and 22. The casters 16 each include a mounting bracket 24 attached to the lower surface of one of the opposite ends of the transverse frame members 20 and 22 and an angular shaft 26 extending downwardly from the mounting bracket 24 and an inclined end supporting a roller 28.

Figure 4:
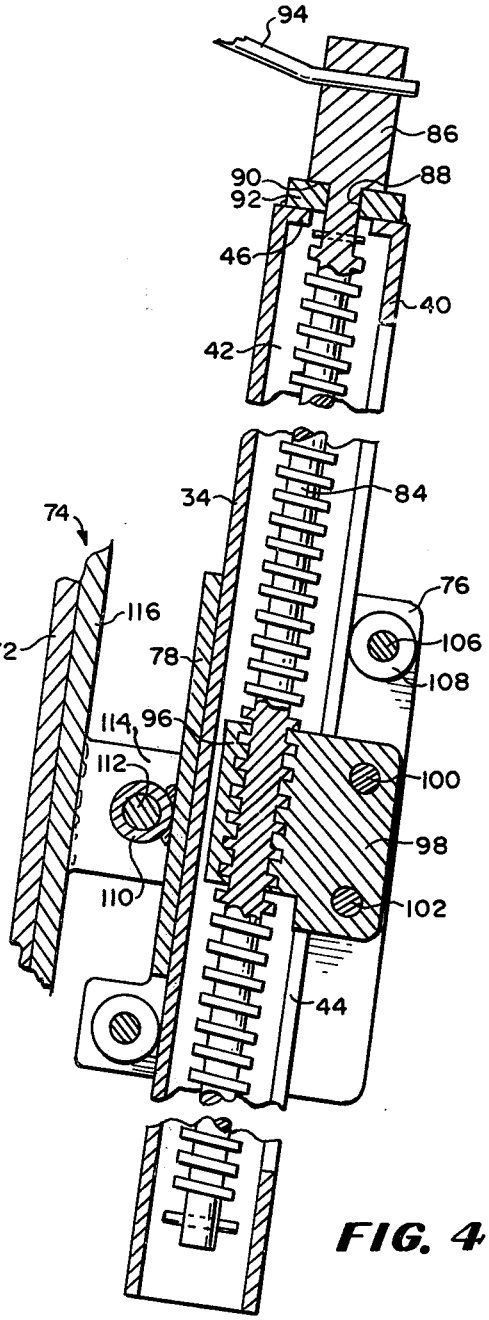
FIG. 4 is an enlarged cross section view taken along line 4—4 in FIG. 2.

The work holder 10 also includes an upright member 30 supported by the frame 14. While the upright member 30 may be connected to the frame 14 in various ways, in the illustrated construction, the upright member 30 is supported by a pair of plates 32 which are rigidly attached to the opposite sides of the frame member 18 adjacent its rearward end by a pair of bolts 33. The lower end of the upright member 30 is positioned between the plates 32 and is integrally connected to the plates by a welded connection. While the upright member 30 may also have alternative constructions, in the illustrated embodiment, the upright member 30 comprises an elongated hollow tube having a generally rectangular cross section. More specifically, the upright member 30 includes a planar front face 34, a pair of planar sides 36 and 38 and a planar rear face 40. The upright member 30 also includes an elongated central chamber 42 (FIG. 4). The planar rear face 40 is bisected by a longitudinal slot 44 extending upwardly from the lower end of the upright member 30 to a point adjacent to but spaced from, its upper end. The upper end of the upright member 30 is closed by a planar end wall 46.

The work holder 10 further includes a support member 50, supported by the upright member 30 for generally vertical movement and also being intended to support thereon a workpiece such as the vehicle door 12. While the support member 50 can be constructed in various ways, in the illustrated embodiment, the support member 50 includes a rigid U-shaped generally horizontal tube 52 having a pair of spaced parallel legs 54 and 56 interconnected by a bight portion 58. The bight portion 58 of the horizontal tube 52 is welded to the lower edge of the front face of a mounting plate 72 of a mounting plate assembly 74. The parallel legs 54 and 56 of the horizontal tube 52 extend forwardly away from the upright member 30 and include free ends supporting a support bar 60 therebetween. The support bar 60 has an upwardly opening V-shaped cross section and is supported at its opposite ends by a pair of collars 62 and 64. One of the collars 62 and 64 is welded to a lower edge on one end of the support bar 60, and the other of the collars 62 and 64 is welded to a lower edge of the other end of the support bar 60. The collar 62 is slidably positioned on the free end of the leg 54 of the U-shaped tube 52 and can be secured thereon by a thumb screw 66 threadably supported in a radially extending bore in the collar 62 and having an end engaging the leg 54. Similarly, collar 64 is slidably positioned on the free end of the leg 56 of the U-shaped tube 52 and is secured by a thumb screw 68 threadably supported in a radially extending bore in the collar 64 and having an end engaging the leg 56. The V-shaped support bar 60 presents an upwardly opening V-shaped groove 70 for receiving the lower edge of the door 12 or another workpiece.

Means are further provided for supporting the support member 50 for generally vertical movement. While various arrangements can be employed, in the illustrated construction, the mounting plate assembly 74 is supported by a bracket member 76 which is movable longitudinally on the inclined upright member 30. The bracket member 76 includes a U-shaped channel section including a planar bight portion (FIG. 4) 78 and a pair of sides 80 and 82 joined by the bight portion 78. The planar bight portion 78 of bracket 76 is slideably positioned against the planar front face 34 of the upright member 30 and the sides 80 and 82 of the bracket 76 are slideably positioned against the sides 36 and 38, respectively, of the upright member 30. An elongated screw 84 is rotatably housed in the central cavity 42 of the upright member 30 and includes an end extending upwardly through a bore 88 in the upper wall 46 of the upright member 30. The screw 84 includes an enlarged cylindrical upper end 86 having a lower annular shoulder 90 resting on a collar 92, in turn supported by the upper surface of the upper wall 46 of the upright member 30. A handle 94 is attached to the enlarged cylindrical upper end 86 of the screw 84 to permit rotation of the screw.

Means are also provided for threadably coupling the bracket member 76 to the screw 84 to facilitate movement of the bracket member 76 in the direction of the longitudinal axis of the screw 84 and the upright member 30 in response to rotation of the screw 84. While various arrangements can be provided, in the illustrated construction a cylindrical sleeve 96 (FIG. 4) having a threaded bore therein surrounds the screw 84. A vertical plate 98 is welded or otherwise rigidly connected to the sleeve 96 and extends outwardly through the slot 44 in the rearward wall 40 of the upright member 30. The plate 98 is connected to the U-shaped bracket member 76 by a pair of bolts 100 and 102 which extend through aligned bores in the side walls 80 and 82 of the U-shaped bracket 76 and also through bores in the vertical plate 98. The plate 98 is maintained in equidistant relation between the sides 80 and 82 of the bracket 76 by cylindrical spacer sleeves 104 which surround the bolts 100 and 102 and are positioned between the plate 98 and the respective side walls 80 and 82 of the bracket 76. The side walls 80 and 82 are also joined by a bolt 106 and are maintained in properly spaced relation by a cylindrical spacer sleeve 108 surrounding the blot 106 and positioned between the sides 80 and 82.

Means are further provided for supporting the support member 50 for pivotal movement with respect to the bracket member 76 and with respect to a generally horizontal axis. While various arrangements can be provided, in the illustrated construction such means includes a hinge mechanism formed by a horizontal sleeve 110 (FIG. 4) welded to or otherwise fixedly attached to and extending forwardly from the bight portion 78 of the bracket 76. The sleeve 110 includes a bore therethrough for receiving a bolt 112. The bolt 112 functions as a pivot pin and supports a pair of rearwardly extending spaced vertical plates 114 which extend rearwardly from the rear face of a mounting plate 116 of the mounting plate assembly 74. The plates 114 include aligned bores therethrough and are pivotable on the bolt 112 to permit pivotal movement of the mounting plate assembly 74 about the horizontal axis of the bolt 112 and to permit consequent pivotal movement of the support member 50 with respect to the bracket 76.

Figure 3:
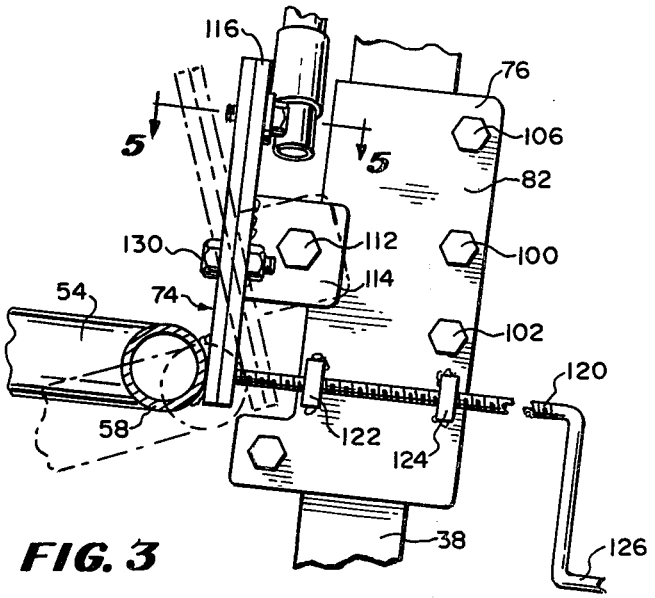
FIG. 3 is an enlarged cross section view taken along line 3—3 in FIG. 2.

Means are also provided for causing pivotal movement of the support member 50 and the mounting plate assembly 74 about the axis of the bolt 112. While other arrangements can be provided, in the illustrated construction an adjustment screw 120 (FIG. 3) is threadably supported by a pair of projections 122 and 124 which extend laterally from the side wall 82 of the bracket 76 and which include aligned threaded bores for threadably receiving the screw 120. The screw 120 includes a handle 126 at one end such that the screw 120 can be rotated. The opposite end of the screw 120 is positioned against the rear face of the mounting plate 116 of the mounting plate assembly 74 below the axis of the bolt 112 and rearwardly of the bight portion 58 of the tubular member 52. Rotation of the screw 120 causes advance or forward movement of the screw against the plate 116 of the mounting plate assembly 74 and consequent pivotal movement of the mounting plate assembly 74 and the support member 50 to thereby provide for adjustment of the angular position of the support member 50.

Figure 5:
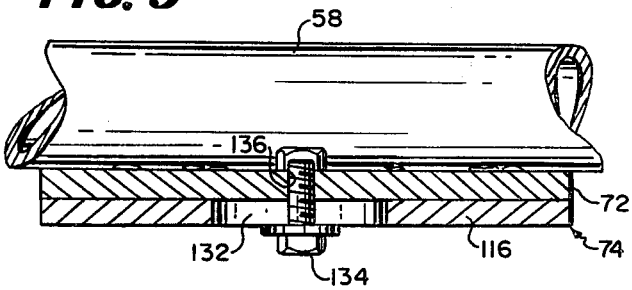
FIG. 5 is an enlarged cross section view taken along line 5—5 in FIG. 3.
Figure 6:
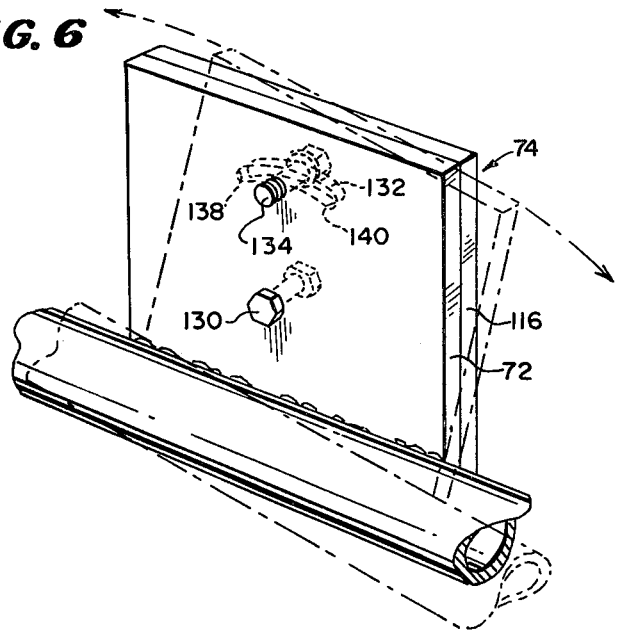
FIG. 6 is an enlarged perspective view of the mounting plates of the work holder shown in FIG. 1.

Means are also provided for supporting the support member 50 for tilting movement with respect to the bracket 76 and with respect to the upright member 30 about an axis transverse to the axis of the bolt 112 and transverse to the upright member 30. While various arrangements can be provided, in the construction illustrated in FIGS. 5 and 6, the mounting plates 72 and 116 of the mounting plate assembly 74 are supported in adjacent parallel relationship by a bolt 130. The mounting plate 72 is rotatable about the bolt 130 with respect to the mounting plate 116 to thereby permit adjustment of the relative position of the mounting plate 72 with respect to the mounting plate 116. The mounting plate assembly 74 is also provided with means for limiting the relative pivotal movement of the mounting plate 72 and 116. In the illustrated construction, such means include an arcuate slot 132 cut in the mounting plate 116 and a bolt 134 extending through the arcuate slot 132 and threadably received in a bore 136 in the other mounting plate 72.

In operation, if it is desired to pivot the support member 50 and the workpiece supported thereon to provide for alignment of the workpiece during installation of the workpiece or alignment of the support member 50 with the workpiece during removal of that workpiece, the bolt 134 can be loosened to thereby facilitate relative pivotal movement of the support member 50 with respect to the mounting plate 116. The relative pivotal movement of the mounting plates 72 and 116 is limited by engagement of the bolt 134 with the opposite ends 138 and 140 of the slot 132.

As previously described, the support member 50 is intended to be positioned below a workpiece to support that workpiece. The work holder 10 also includes means for engaging and supporting the upper portion of a workpiece. While other arrangements can be provided, in the illustrated construction the means for supporting the upper portion of the workpiece includes a pair of upwardly and outwardly diverging arms 142 and 144 supported by the mounting plate 116. The diverging arms 142 and 144, in turn, each support an elongated rod 146 and 148, respectively. The elongated rods 146 and 148 each include a free end supporting a suction cup 150, the suction cups 150 functioning to engage an upper portion of a workpiece such as the vehicle door 12 illustrated in FIG. 1. The upwardly and outwardly diverging arms 142 and 144 are each supported at their lower ends by a hollow cylindrical sleeve or socket 152 welded or otherwise fixedly secured to the rearward face of the mounting plate 116. Set screws 154 extend through threaded bores in the cylindrical sleeves 152 to engage the upwardly and outwardly diverging arms 142 and 144 to secure them with respect to the sleeves 152.

Means are further provided for supporting the elongated rods 146 and 148 on the upwardly and outwardly diverging arms 142 and 144, respectively. While other arrangements can be provided, in the illustrated construction, collar assemblies 160 are supported on the upwardly and outwardly diverging arms 142 and 144. The collar assemblies 160 each include a pair of cylindrical collars 162 and 164 secured together such that the longitudinal axes of the collars 162 an 164 are disposed in angular relation to each other. The collars 162 are slidably positioned on an end of one of the upwardly and outwardly extending arms 142 and 144 and are secured thereto by set screws 168. The collars 162 are circumferentially and longitudinally adjustable on the arms 142 and 144 if the set screws 168 are loosened. The collars 164 are rigidly connected to the collars 162 and support the elongated rods 146 and 148. Rods 146 and 148 are longitudinally adjustable in the collars 164 and are releasably secured with respect to the collars 164 by set screws 170.

In operation, the suction cups 150 can be aligned for engagement with a workpiece by loosening thumb screws 168 and 170 whereby the elongated rods 146 and 148 will be longitudinally movable and such that the collars 162 will be movable longitudinally and circumferentially on the support arms 142 and 144.

Various of the features of the invention are set forth in the following claims.

What is claimed is:

1. A work holder for supporting a workpiece, the work holder including a frame, an upright member supported by said frame and having a longitudinal axis, a support member for supporting the workpiece, means for supporting the support member for movement along said longitudinal axis including a bracket member supported by said upright member and movable longitudinally on said upright, for pivotal movement about a generally horizontal axis, and for tilting movement about an axis transverse to said generally horizontal axis and transverse to said upright member, an upwardly and outwardly extending arm supported by said bracket member, a second arm supported by said upwardly and outwardly extending arm, said second arm having a free end supporting a suction member, said suction member being engageable with said workpiece for support thereof, a pair of collars, each of said collars having a longitudinal axis, said collars being joined together in side-by-side relation and with the longitudinal axes of said collars being angularly disposed, one of said collars being adjustably supported longitudinally and circumferentially on said upwardly and outwardly extending arm, and the other of said collars supporting said second arm for adjustable positioning thereof.

2. A work holder for supporting a workpiece, said work holding including a frame, an upright member supported by said frame and having a longitudinal axis, a bracket, means adjustably supporting said bracket on said upright member for movement longitudinally of said upright member, a first mounting member, a supporting element adapted to engage and support the workpiece, means for adjustably fixing said support element to said first mounting member to variably locate said support element relative to said first mounting member, means adjustably supporting said first mounting member on said bracket for movement about a first axis, a second mounting member, a support member adapted to engage and support the workpiece, means adjustably fixing said support member to said second mounting member to variably locate said support member relative to said second mounting member, and means adjustably supporting said second mounting member on said first mounting member for movement about a second axis perpendicular to said first axis.

3. A work holder in accordance with claim 2 and further including a second support element adapted to engage and support the workpiece, and means for adjustably fixing said second support element to said first mounting member to variably locate said second support element relative to said first mounting member.

4. A work holder in accordance with claim 2 wherein said support element includes an outer end having thereon a suction member engageable with the workpiece.

5. A work holder in accordance with claim 2 wherein said support element comprises a first arm extending upwardly from said first mounting member, a second arm extending from said first arm and having an outer end with a suction member, and means for connecting said first and second arms for adjustment therebetween to variably locate said suction member relative to said first mounting member.

6. A work holder as set forth in claim 2 wherein said means for supporting said bracket for movement longitudinally of said upright member includes a rotatable screw supported by said upright member in generally parallel relation to said upright member, and means for threadably coupling said bracket to said screw for causing movement of said bracket longitudinally on said upright member in response to rotation of said screw.

7. A work holder as set forth in claim 6 wherein said upright member comprises an elongated hollow structure and wherein said screw is supported therein, and wherein said coupling means includes a member having a threaded bore threadably housing said screw and connected to said bracket whereby said coupling means member and said bracket are movable longitudinally on said upright member when said screw is rotated.

8. A work holder as set forth in claim 2 wherein said means for adjustably supporting said second mounting member on said first mounting member includes a bore in one of said mounting members, and a pivot member extending from the other of said mounting members and positioned in said bore, and further including means for limiting the relative movement of said first and second mounting members including an arcuate slot in one of said mounting members and a member extending from the other of said mounting members into said slot.

9. A work holder as set forth in claim 2 wherein said means for supporting said first mounting member for movement includes a generally horizontal pivot pin supported by said bracket.

10. A work holder as set forth in claim 9 and further includes means for pivoting said first mounting member about said pivot pin, said pivoting means including a threaded bore in said bracket, and a screw supported in said threaded bore and including an end engageable against said first mounting member for pivoting said first mounting member upon rotation of said screw.

11. A work holder as set forth in claim 2 wherein said supporting element includes an upwardly and outwardly extending arm supported by said first mounting member, and a second arm supported by said upwardly and outwardly extending arm, said second arm having a free end supporting a suction member, said suction member being engageable with said workpiece for supporting said workpiece.

12. A work holder as set forth in claim 11 and further including a pair of collars, each of said collars having a longitudinal axis and said collars being joined together in side-by-side relation and with the longitudinal axes of said collars being angularly disposed, one of said collars being adjustably supported longitudinally and circumferentially on said upwardly and outwardly extending arm, and the other of said collars supporting said second arm for adjustable positioning thereof in said other of said collars.

* * * * *